US005683146A

United States Patent [19]

Falleiros et al.

[11] Patent Number: 5,683,146

[45] Date of Patent: Nov. 4, 1997

[54] DEVICE FOR SELECTIVELY SEPARATING AND CUTTING TOOTHBRUSH BRISTLES

[76] Inventors: Alexandre Petrocini Falleiros, Praca Romao Gomes, No. 8, apt° 33; Bernard Reinesch, Avenida Cidade, Jardim No. 3141, apt°119; Paulo Rogerio Braga Lima, Rua Antares No. 175, apt° 102C, all of San Jose dos Campos, Sao Paulo, Brazil

[21] Appl. No.: 734,250

[22] Filed: Oct. 16, 1996

Related U.S. Application Data

[63] Continuation of Ser. No. 523,989, Sep. 5, 1995, abandoned, which is a continuation of Ser. No. 277,544, Jul. 19, 1994, abandoned.

[51] Int. Cl.[6] ..... A46D 1/04; A46D 1/06; A46D 9/02

[52] U.S. Cl. ..... 300/2; 300/11; 300/17; 300/18

[58] Field of Search ..... 300/2, 3, 4, 5, 300/6, 7, 8, 9, 10, 11, 18, 17

[56] References Cited

U.S. PATENT DOCUMENTS 5,143,425 9/1992 Boucherie ..... 300/2

5,593,213 1/1997 Meessmann ..... 300/21

FOREIGN PATENT DOCUMENTS 0078569 5/1983 European Pat. Off. .

0639340 2/1995 European Pat. Off. .

1532773 1/1971 Germany .

*Primary Examiner*—John M. Husar

[57] ABSTRACT

This invention refers to a device for selective separation of toothbrush bristles that allows the toothbrush bristles to be cut into different lengths and profiles in different selected areas. According to this invention, the device ;for selective separation of toothbrush bristles comprises a base with fixation means for a toothbrush having bristles, and a support assembled over the base, wherein the support comprises a pair of simetrically pivoting stems over a first geometric plane, the support being displaceable over a portion of the base along a geometric axle that is parallel to the first geometric plane, from a resting position to a position of contact between the stems and the bristles and a cam means cooperating with the respective portions of the stems, during at least part of the displacement of the support over the base, in order to cause the symmetrically pivoting movement of the stems. Additionally, this invention refers to a device for selective cutting of toothbrush bristles comprising the above mentioned device for selective separation.

17 Claims, 6 Drawing Sheets

DEVICE FOR SELECTIVELY SEPARATING AND CUTTING TOOTHBRUSH BRISTLES

This is a continuation of application Ser. No. 08/523,989, filed Sep. 5, 1995, now abandoned which is a continuation of Ser. No. 08/277,544, filed Jul. 19, 1994, now abandoned both of which are hereby incorporated by reference.

BACKGROUND OF THE INVENTION

This invention refers to a device for selective separation of toothbrush bristles, which allows toothbrush bristles to be cut according to different lengths and profiles in different selected areas, and which comprises a base with fixation means for a toothbrush and a support assembled over the base. In a second aspect, this invention is translated into a device for selective cutting of toothbrush bristles including the device for selective separation of bristles.

A layout today frequently found in toothbrushes is that in which the toothbrush bristles have different lengths, some of them longer and other shorter, having for objective to provide an efficient and healthy cleaning of the user's teeth.

Document EP 0.458.999 discloses a device to cut toothbrush bristles into different sizes in different selected areas, comprising a support to fix the toothbrush head and at least a protecting plate associated to a determined area of the toothbrush bristles and mobile between a resting position far from the head and the bristles end, and an active position, near to the head. The protecting plate is provided with board means to couple the bristle ends in the selected area and to provide a radial component of movement to the coupled bristle ends, folding the corresponding bristles to far from the bristles located outside the selected area, through the movement of said board in axial direction, from upward to downward, from a resting position to an active position.

This device is applicable in the separation of bristles of toothbrushes having any head shape whatsoever. However, for such purpose, the protecting plates should have different shapes, each of them being specifically applicable to a cutting standard to be effected in a determined toothbrush head shape. Additionally, depending on the desired cutting standard and the toothbrush head shape, the plates may have a quite complex configuration, it being difficult to model them and thus requiring high manufacturing costs.

Another provision usually employed for the selective cutting of toothbrush bristles comprises a base with fixation means for a toothbrush and a mobile support over the base, the support comprising also a pair of stems which are fixedly assembled in the support and which advance in perpendicular direction towards the toothbrush bristles when the support is moved over the base.

This device has the disadvantage that the stems are able to separate only bristle tufts which are aligned in a parallel line to the toothbrush longitudinal axle. Particularly in the case of the toothbrush with triangular head or snake head, the bristle tufts are irregularly cut, once the tufts are not provided in a parallel line to the toothbrush longitudinal axle.

OBJECTS OF THE INVENTION

The objective hereof is that of providing a device for selective separation of toothbrush bristles, able to accurately separate a group of bristles which are in a determined and selected area from those which are outside the selected area, thus allowing the toothbrush bristles to be cut into different lengths and profiles in the different selected areas.

Another objective hereof is that of providing a device for the selective cutting of toothbrush bristles including a device for the selective separation of bristles.

SUMMARY OF THE INVENTION

These objectives can be achieved due to the fact that the device for selective separation of toothbrush bristles comprises a support having a pair of symmetrically pivoting stem, over a first geometric plane, the support being displaceable over a portion of the base along a geometric axle that is parallel to said first geometric plane, from a resting position to a contact position of the stems with the toothbrush bristles, and a means of cam cooperating with the respective portions of the stems, during at least part of said displacement of the support over the base, in order to cause the symmetrically pivoting movement of the stems.

Thus, according to a preferred embodiment, the device for selective separation of toothbrush bristles comprises a support that is mobile over a base, from the resting position to the contact position of the stems with the bristles or cutting position, along at least a guide pin fixedly assembled over the base, with at least one spring provided between the base and the support.

Each pivoting stem comprises a contact roller which is contact with the means of cam, and one of the stem ends has the function of acting over the bristles of the toothbrush that is fixed on the base fixation means. The means of cam is configurated in a plate with a determined shape, which plate is fixedly assembled over the base. In a preferred embodiment of this invention, the means of cam is of a substantial losangle shape, being appropriate for selective separation of a triangle head toothbrush bristles. Yet, between each stem and the support is a spring having the function of keeping the stem rollers in contact with the contour of the means of cam.

Preferably, the pivoting stems are of prismatic shape. In another embodiment, each of the stems comprises two flat and elongated portions disposed in right angle between them. Yet in another embodiment, the stems surface being responsible for the bristles displacement is in a substantially curve form.

In another aspect of this invention, a device is provided for the selective cutting of toothbrush bristles, comprising a base with fixation means for a toothbrush with bristles, a support assembled over the base and a roller to cut bristles, where the support comprises a pair of symmetrically pivoting stems over the first geometric plane, the support being displaceable over a portion of the base along a geometric axle that is parallel to said first geometric plane, from a resting position to a contact position of the stems with said bristles, during at least part of said displacement of the support over the base, in order to cause the symmetrically pivoting movement of the stems.

BRIEF DESCRIPTION OF THE DRAWINGS

The invention is following described in detail, with basis on an example of non-limitating execution as shown in the drawings. Figures show.

Figure 1:
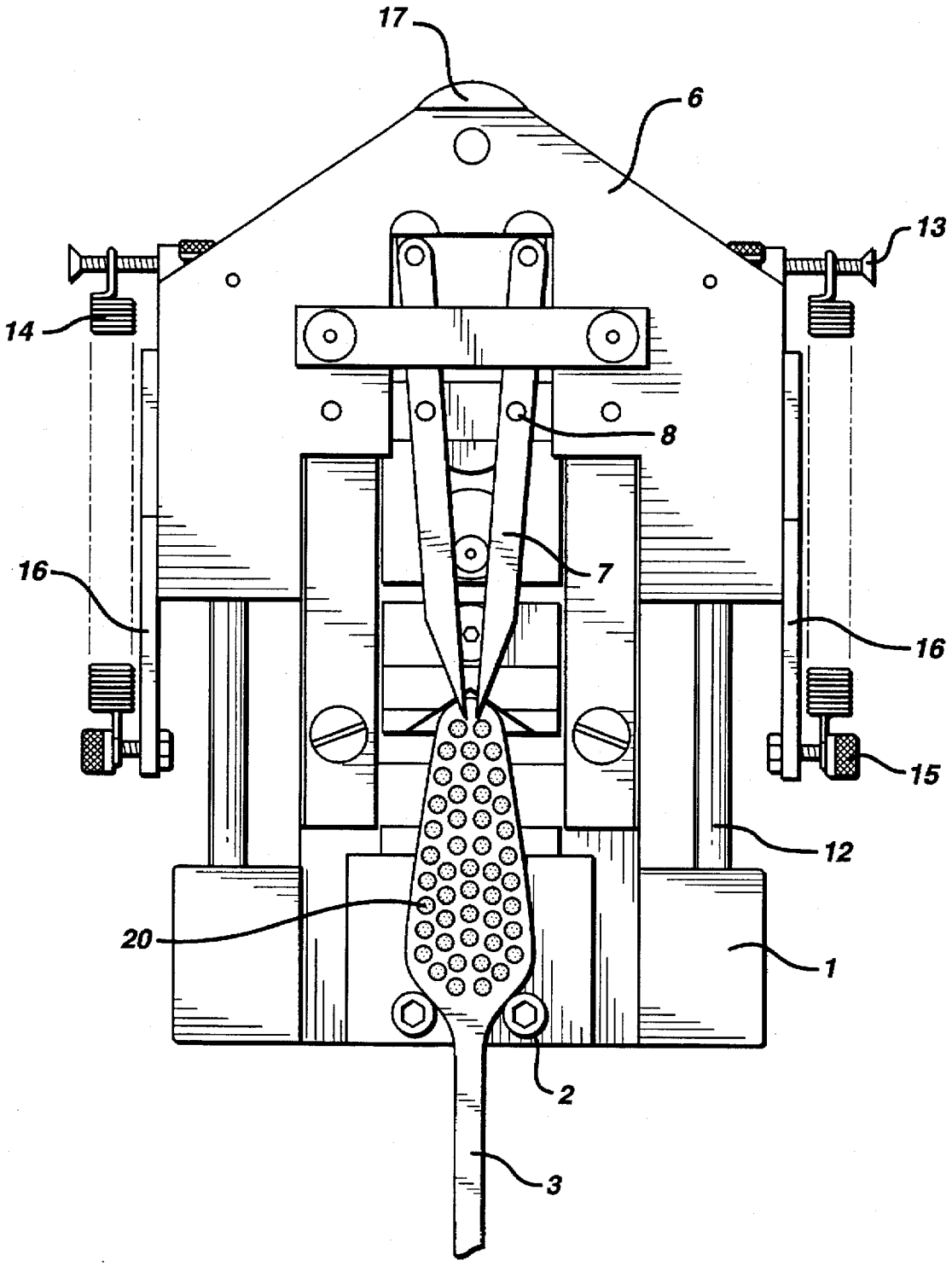
FIG. 1—an upper plan view of the device for selective cutting of toothbrush bristles in the resting position, with a triangle or snake head toothbrush fixed to the device base.
Figure 6:
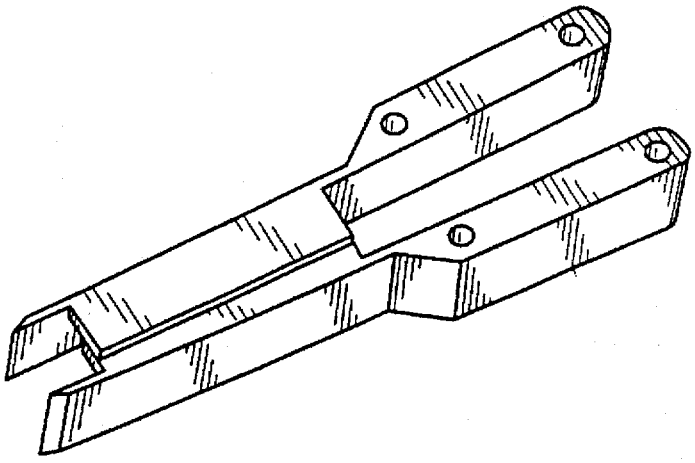
Figure 7:
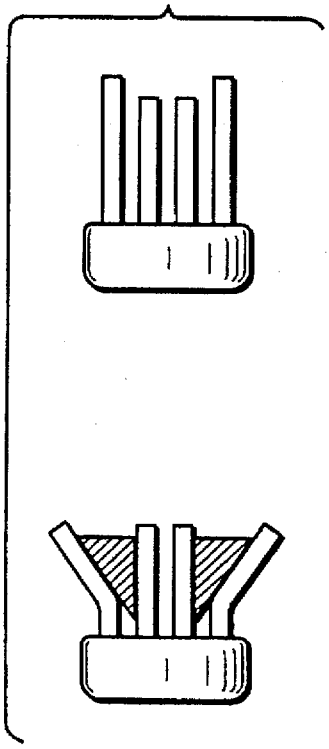
Figure 8:
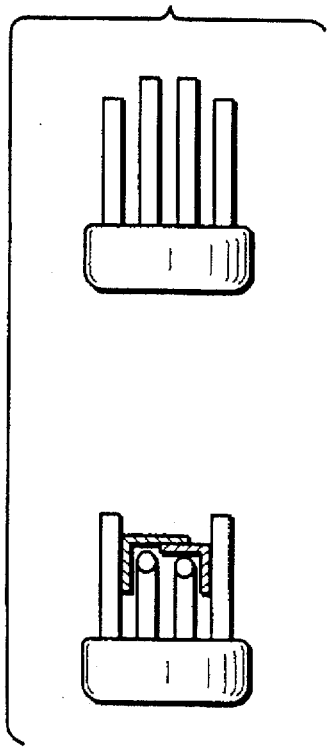

FIG. —a schematic view of a second concretization for the separating pivoting stems of the device shown in FIG. 1;

FIG. 7—a schematic view of the toothbrush head having the outside bristles already separated from the central bristles for further cutting of the latter;

FIG. 8—a schematic view of the toothbrush head having the central bristles already separated from the outside bristles through separating stems of the type shown in FIG. 6, for further cutting of the outside bristles.

DETAILED DESCRIPTION OF THE PREFERRED EMBODIMENTS

According to a preferred embodiment of this invention, the device for selective cutting of toothbrush bristles comprises a base 1 with fixation means 2 for a toothbrush head 3 having bristles 20 which are vertically projected from their surface, and a mobile support 6 over the base 1 and from a resting position to a cutting position.

Figure 4:
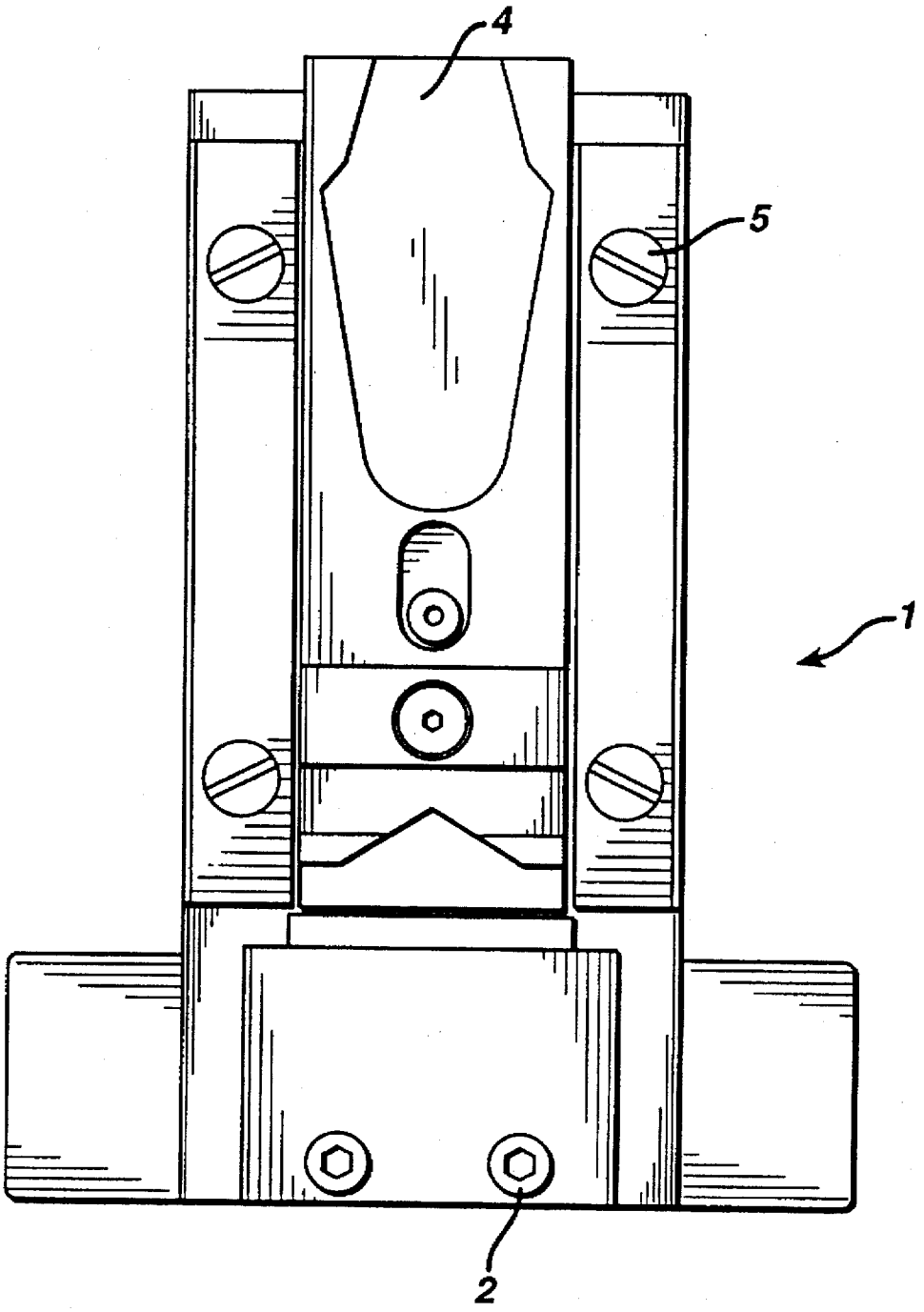
FIG. 4—an upper plan view of the base of the device shown in FIG. 1.

As better shown in FIG. 4, base 1 comprises one means of cam 4 composed of a depression of appropriate shape configurated in a plate fixed to base 1 through screws 5.

Figure 5:
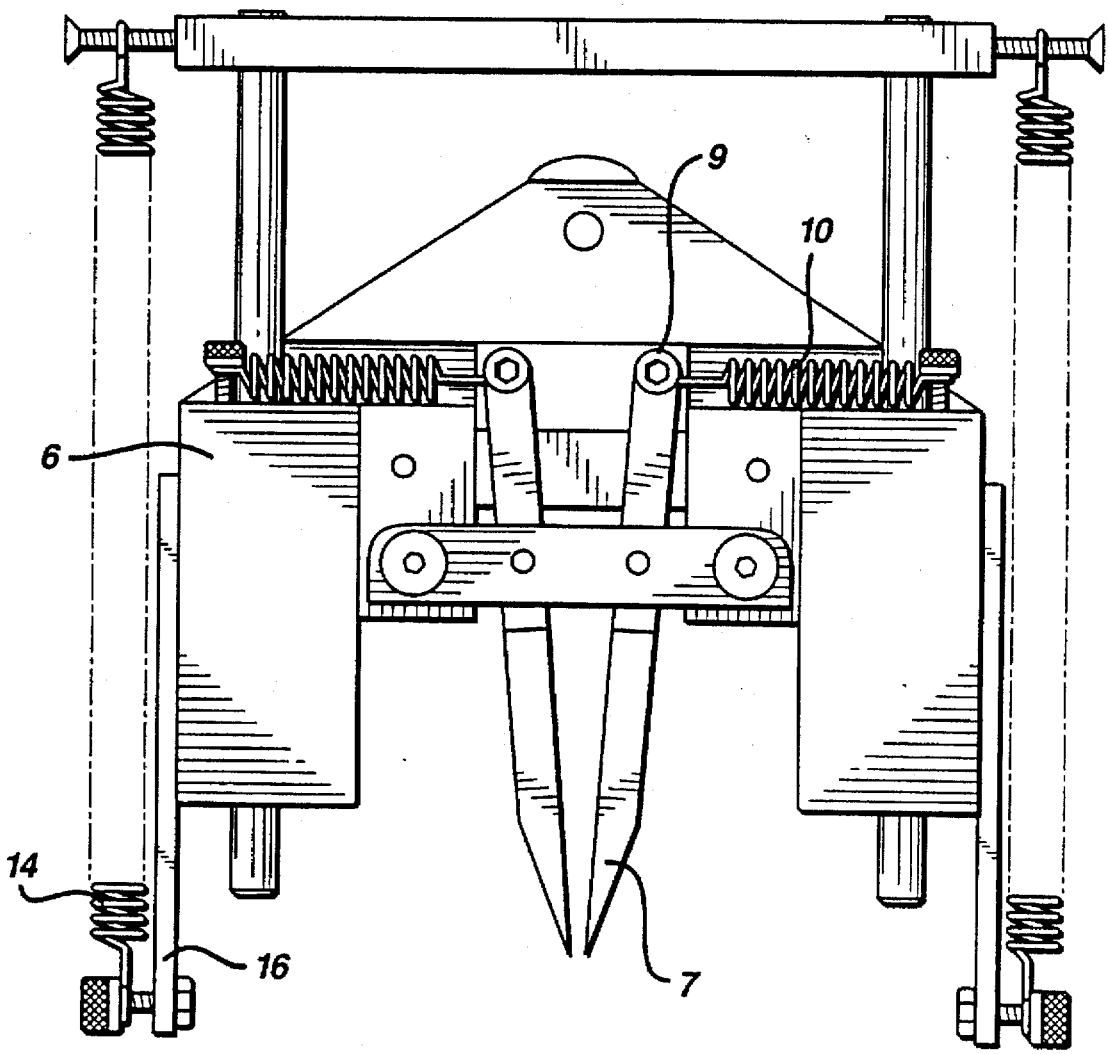
FIG. 5—a bottom plan view of the support of the device shown in FIG. 1.

Support 6 comprises a pair of stems with prismatic shape 7, which are pivotedly assembled in support 6 through joints 8. As it can be seen in FIG. 5, in one end of each stem 7 is a roller 9 which is linked to support 6 through a spring 10. Thus, as better shown in FIG. 3, when the support 6 is assembled over base 1, rollers 9 of stems 7 are provided in the interior of cam means 4, springs 10 having the function of keeping rollers 9 in permanent contact with the contours of cam means 4. Thus, when support 6 advances towards base 1, from the resting position to the cutting position, stems 7 are provided with a relative movement of opening and closing, similar to the movement of scissor blades, with their most extreme portions being close or far one from the other according to the shape of the contour of the means of cam 4.

Stems 7 are symmetrically pivoting over a first geometric plane, with support 6 being mobile over base 1, from the resting position to the cutting position, along a geometric axle that is parallel to this first geometric plane. Thus, the first geometric plane, over which stems 7 are symmetrically pivoting during the advance of support 6 over base 1, is perpendicular to bristles 20 of toothbrush 3 that is attached to fixation means 2, as it can be observed in FIGS. 1 and 2.

Thus, upon advancing over the bristles, stems 7 accurately and progressively separate one selected portion of the toothbrush bristles, according to the contours of the means of cam 4, pushing the bristles which are in the selected area away from those which are outside the selected area.

Figure 2:
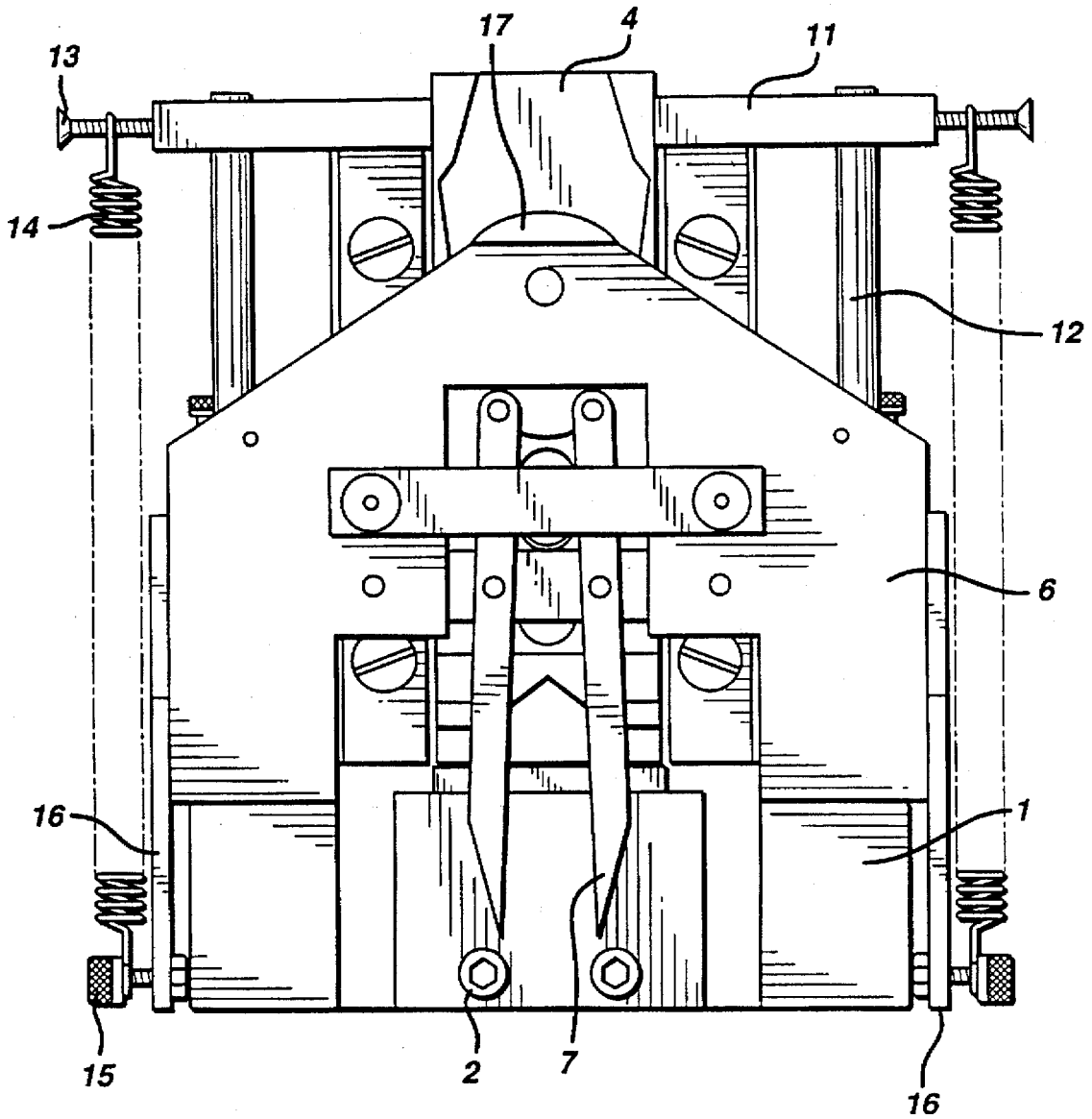
FIG. 2—an upper plan view of the device shown in FIG. 1 in the contact position of the stems with the bristles or cutting position.
Figure 3:
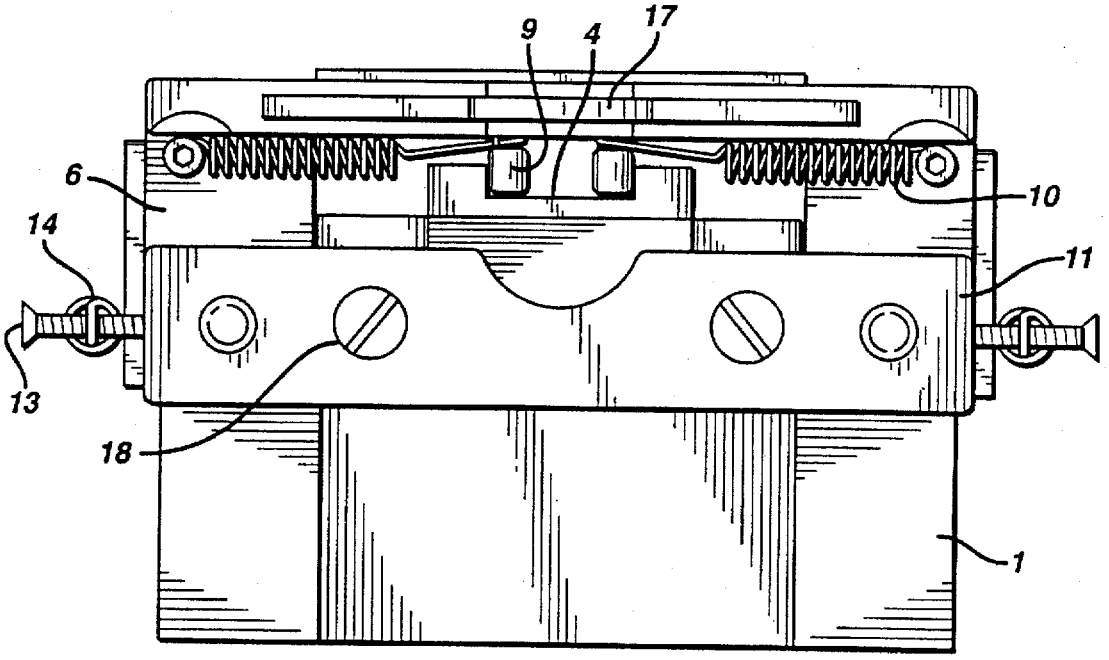
FIG. 3—an upper plan view of the device shown in FIG. 1.

As it can be better seen in FIGS. 2 and 3, base 1 is provided also with a plate 11 fixed by screws 18 in the opposed end to that end which comprises the fixation means 2 for toothbrush. Plate 11 is provided with a pair of guide pins 12 spaced between them, which are disposed on both sides of base 1 and which cross the support 6 through the corresponding holes, and are intruded in a pair of holes provided on the other end of base 1. Thus, as it can be seen in FIGS. 1 and 2, support 6 is mobile over base 1, from the resting position to the position of contact of stems 7 with bristles 20 or cutting position, through guide pins 12.

Plate 11 is also provided with screws 13, and in each of them the end of a spring 14 is attached. The other end of each of the springs 14 is attached to a screw 15 provided on the end of projecting plates 16 fixed through screws on each side of support 6.

In a realization of this invention, base 1 is fixed on a working station wherein, for example, a pneumatically driven acting element (not shown) runs perpendicularly to the geometric axle of diplacement of support 6. The acting element has a cant shape and is in contact with a roller 17 provided on the back portion of support 6. Thus, when the acting element begins to move, support 6 is progressively displaced from the resting position to the cutting position, as schematically shown in FIGS. 1 and 2.

As already mentioned, upon displacing over base I pivoting stems 7 of support 6 are displaced in perpendicular manner to the toothbrush bristles, describing a symmetrically pivoting movement such as defined by cam means 4, while rollers 9 of stems 7 advance through the contours of cam means 4. Thus, upon advancing among the toothbrush head bristles, the stems separate a selected group of bristles, providing them with a side inclination in relation to the flat face of the toothbrush head, in a way to push them away from those bristles which are in the cutting area.

As shown in FIG. 4, cam means 4 has a shape determined by two diverging lines that subsequently converge and meet, so that the device shown is particularly appropriate for the selective separation of bristles in triangle head toothbrushes.

After the support reaches its maximum advance position, that is, after reaching its cutting position, in which all bristles in the selected area have already been pushed away from the other bristles, a bristles cutting roller (not shown) enters into contact with bristles outside the selected area, cutting them into a determined length and profile. After cutting, the driving member of support 6 pneumatically returns to its initial position, progressively releasing support 6 that returns to its resting position through the action of springs 14.

The above mentioned cutting rollers is widely known by those acquainted with the technique, not being thus shown in the annexed drawings.

Simultaneously with the return of support 6 to its resting position, the pivoting stems 7 start to release the toothbrush bristles which were in the selected area, in such a way that these retake their initial vertical position. However, it is possible that some of these bristles do not return to the vertical position. In these cases, a comb-type device may be used to bring them to their original position, which device is also widely known to those acquainted with the technique, not being thus shown in the annexed drawings.

In another realization of the invention, base 1 is mobile over the rolling track (not shown) in a perpendicular direction to the geometric axle of displacement of support 6. In this realization, the acting element comprises a fixed plate (not shown), having a boss or protuberance that is responsible for the displacement of support 6 over base 1 while support 6 roller 17 accompanies the profile of said plate.

As shown in the Figures, the device of this invention may be used to separate more peripheral bristles from bristles comprising a triangle head toothbrush 3. Thus, for example, upon advancing towards the toothbrush bristles, the pivoting stems 7 separate the peripheral bristles from the central ones, providing the peripheral bristles with a radial movement, pushing them away from more central bristles.

In this case, after the cutting the bristles show a configuration in which the more peripheral bristles are than the central ones, as schematically shown in FIG. 7.

In another embodiment, the device of this invention may be applied to allow only the cutting of more peripheral bristles. In this case, stems with prismatic section are replaced by stems which comprise two flat and elongated portions provided in a right angle between them. FIG. 6 schematically shows a pair of stems of this type. These stems forming a right angle are overlaped when in operation, in such a way that when the device reaches its cutting position, the most central bristles of the toothbrush are insulated from the most peripheral bristles, thus allowing that only these most peripheral bristles are cut by the cutting roller, as schematically shown in FIG. 8.

It must be observed that the device of this invention may be used to separate bristles of toothbrushes with different head shapes, as well as it can be used to separate different groups of bristles among the bristles comprising the toothbrush, it being enough for this purpose to vary the configuration of the cam means 4 provided in base 1 and the shape of pivoting stems 7. Thus, for example, in case a cam means having a contour defined by parallel side walls were used, parallel groups of bristles might be separated in the toothbrush.

In another embodiment, cam 4 might consist of a protuberance in base 1, against which salient wall rollers 9 of stems 7 would be forced, for example by means of a sole spring provided between pivoting stems 7. Further, the rollers might be replaced by dry ends, that is, "followers" which would accompany the cam walls.

It shall be readily understood that the device for selective cutting of toothbrush bristles, as shown in the drawings, only exemplifies the invention in its presently preferred form, wherein the scope of protection of this invention should be limited only by the terms of the attached claims.

We claim:

1. Device for selective separation of toothbrush bristles, comprising a base with fixation means for a toothbrush having bristles, and a support assembled over said base:

said support comprising a pair of symmetrically pivoting stems over a first geometric plane, said support being displaceable over a portion of said base along a geometric axle that is parallel to said first geometric plane, from a resting position to a position of contact between said stems and said bristles; and a cam means cooperating with the respective portions of said stems, during at least part of the displacement of said support over said base, in order to cause the symmetrically pivoting movement of said stems.

2. Device according to claim 1, wherein said support is moved over said base, from the resting position to the position of contact between said stems and said bristles, along at least one guide pin fixedly assembled over said base.

3. Device according to claim 1, wherein at least one spring is connected between said base and said support.

4. Device according to claim 1, wherein each of said stems comprises a roller in direct contact with said cam means.

5. Device according to claim 4, wherein said rollers of each of said stems are kept in direct contact with the contour of said cam means through the action of springs connected between said stems and said support.

6. Device according to claim 4, wherein said rollers of each of said stems are kept in direct contact with the contour of said cam means through the action of springs connected between each of said stems.

7. Device according to claim 1, wherein said cam means comprises a depression with a determined shape, configurated in a plate fixedly assembled over said base.

8. Device according to claim 7, wherein said cam means has a shape determined by two diverging lines that subsequently converge and meet.

9. Device according to claim 1, wherein said cam means constitutes a boss with a determined shape configurated in a plate fixedly assembled over said base.

10. Device according to claim 1, wherein said stems are of prismatic shape.

11. Device according to claim 1, wherein each of said stems comprises two flat and elongated portions provided in right angle between them.

12. Device according to claim 1, wherein each of said stems has a substantially curved surface.

13. Device for the selective cutting of toothbrush bristles, comprising: one base with fixation means for a toothbrush having bristles, a support assembled over said base and a bristles cutting roller;

said support comprising a pair of symmetrically pivoting stems over a first geometric plane, said support being displaceable over a portion of said base along a geometric axle that is parallel to said first geometric plane, from a resting position to a position of contact between said stems and said bristles; and a cam means cooperating with the respective portions of said stems, during at least part of the displacement of said support over said base, in order to cause the symmetrically pivoting movement of said stems.

14. Device according to claim 13, wherein said support is moved over said base, from the resting position to the position of contact between said stems and said bristles, along at least a guide pin fixedly assembled over said base;

at least one spring connects said base and said support;

each of said stems comprises a roller for contact with said cam means;

said cam means constitutes a depression with a determined shape configurated in a plate that is fixedly assembled over said base, where said rollers of said stems are kept in direct contact with the contour of said cam means through the action of said springs connected between said stems and said support.

15. Device according to claim 13, wherein said stems are in prismatic shape.

16. Device according to claim 13, wherein each of said stems comprises two flat and elongated portions provided in right angle between them.

17. Device according to claim 13, wherein each of said stems has a substantially curved surface.

* * * * *